United States Patent [19]

Franklin

[11] Patent Number: 4,652,704

[45] Date of Patent: Mar. 24, 1987

[54] KEYBOARD SWITCH

[75] Inventor: Gerald K. Franklin, Albuquerque, N. Mex.

[73] Assignee: Sperry Corporation, New York, N.Y.

[21] Appl. No.: 814,456

[22] Filed: Dec. 30, 1985

[51] Int. Cl.[4] ..... H01H 1/06; H01H 13/70

[52] U.S. Cl. ..... 200/5 A; 200/159 B; 200/292

[58] Field of Search ..... 200/5 A, 159 B, 292, 200/11 DA

[56] References Cited

U.S. PATENT DOCUMENTS

| | | | |
|---|---|---|---|
| 4,156,802 | 5/1979 | Gilano et al. | 200/5 A |
| 4,246,452 | 1/1981 | Chandler | 200/5 A |
| 4,287,394 | 9/1981 | Hargita et al. | 200/5 A |
| 4,297,542 | 10/1981 | Shumway | 200/5 A |
| 4,409,450 | 10/1983 | Blades | 200/5 A X |
| 4,423,294 | 12/1983 | Walser et al. | 200/5 A |
| 4,472,609 | 9/1984 | Lamm et al. | 200/5 A |

FOREIGN PATENT DOCUMENTS

| | | | |
|---|---|---|---|
| 3300186 | 11/1983 | Fed. Rep. of Germany | 200/5 A |

*Primary Examiner*—J. R. Scott

*Attorney, Agent, or Firm*—H. P. Terry

[57] ABSTRACT

An improved multiple circuit keypad switch of the type in which a rigid key having a shorting puck on its underside is supported over exposed traces of a printed circuit card by a flexible membrane so that the puck shorts designated exposed traces to close all circuits when the key is depressed, the improvement arising from the layout of the exposed traces in which individual circuits are arranged in concentric rings and the shorting puck contains shorting elements arranged in corresponding concentric rings.

6 Claims, 6 Drawing Figures

KEYBOARD SWITCH

This invention was made with United States Government support and the United States Government has certain rights therein.

BACKGROUND OF THE INVENTION

1. Field of the Invention

The present invention relates to mechanically actuated switches and more specifically to mechanically actuated keypad switches using a conductive rubber membrane.

2. Description of the Prior Art

Keypad switches for controlling circuits included in printed circuit cards are known in the art. In particular, one type of switch consists of a key mounted over exposed traces of a printed circuit card. The key is supported over the exposed traces by an elastic membrane and contains shorting means on its underside which interconnect appropriate exposed traces when the key is depressed.

In many applications, several interconnections must be made simultaneously when the key is depressed. Consider, for instance the dual multipole switching circuit depicted in FIG. 1 wherein terminals 1, 2, and 3 must be interconnected at the same time that terminals 4, 5, and are interconnected.

A prior art keypad switch for perforiming this particular function is illustrated in FIGS. 2A and 2B. A key 7 is supported over a printed circuit card 8 by means of an elastic membrane 9. The portion of the printed circuit card underneath the key contains exposed traces which are to be interconnected when the key is depressed. Conducting discs 10 and 11 are mounted on the underside of the key so as to contact the appropriate exposed traces on the printed circuit card when the key is depressed.

Typically, the key 7 in such prior art switches is formed from relatively thick rubber and the supporting membrane 9 which encircles the base of the key is formed from thin sections of the same material. Typically, also, the conducting discs 10 and 11 are formed from conducting rubber pucks moulded onto the rubber key 7.

FIG. 2B illustrates how the electrical components of the prior art switch would be arranged to perform the dual multipole switching function indicated in FIG. 1.

The conducting rubber pucks 10 and 11 are arranged over the exposed trace arrays 12 and 13 on the printed circuit card.

Each of the exposed trace arrays 12 and 13 effectively consists of a plurality of conducting fingers, each connected to one of the three associated terminals and uniformly interspersed throughout the array. When the key is depressed, the rubber pucks short out several adjacent conducting fingers, thus interconnecting the associated terminals and effectively closing the corresponding switch as depicted in FIG. 1.

Although the above-described prior art switch has great utility, it does have some disadvantages.

Since the key must accommodate two conductive rubber pucks to cover a minimum area, the key must be a rectangle with a length more than two times the diameter of one puck and width at least equal to the diameter of one puck. Since such switches are frequently used in an environment where space is at a premium, such long keys can be a serious problem.

Additionally, the shape of the key permits it to be pressed in a manner to collapse only one end of the key membrane causing only one conductive rubber puck to contact the associated exposed trace array so that only one switch closes. Furthermore, even when both switches close, there is little guarantee that simultaneous contacts will be made.

SUMMARY OF THE INVENTION

A dual multipole keypad switch of the type which contains conductive shorting elements mounted above exposed trace arrays on a printed circuit card utilizes concentric shorting elements and concentric arrays to assure simultaneous opening and closing of the switches.

DESCRIPTION OF THE PREFERRED EMBODIMENT

Figure 2B:
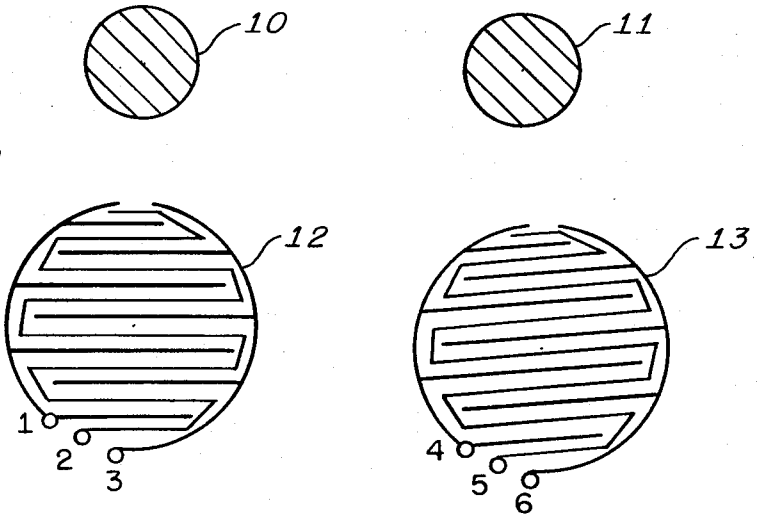
FIG. 2B. PRIOR ART
FIGS. 2A and 2B illustrate a prior art keypad switch.
Figure 1:
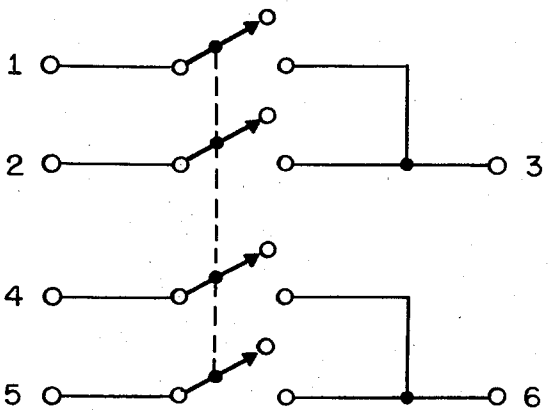
FIG. 1 is a circuit diagram of a typical switching circuit to which the principles of the invention may be applied.
Figure 2A:
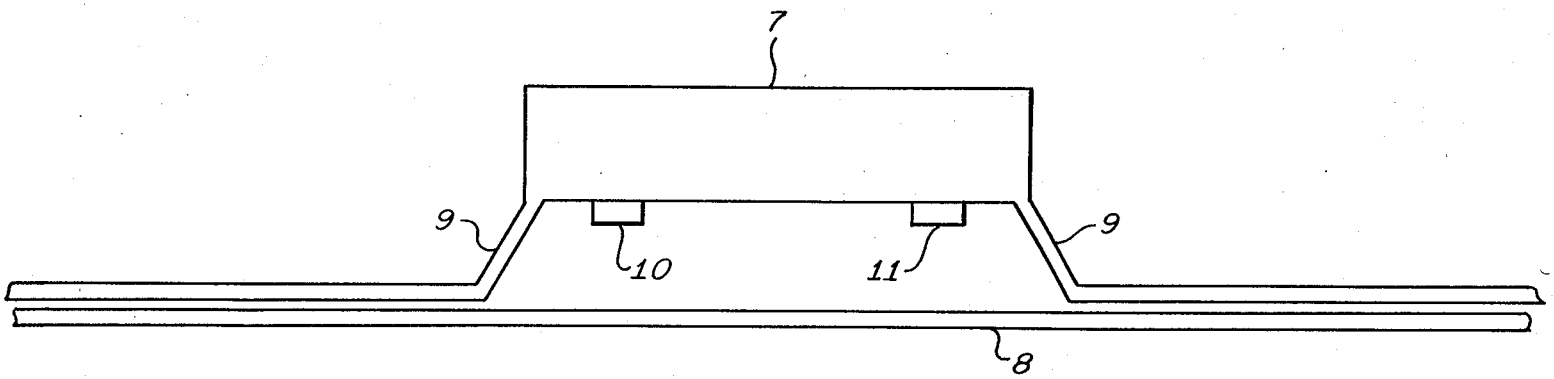
FIG. 2A. PRIOR ART
Figure 3A:
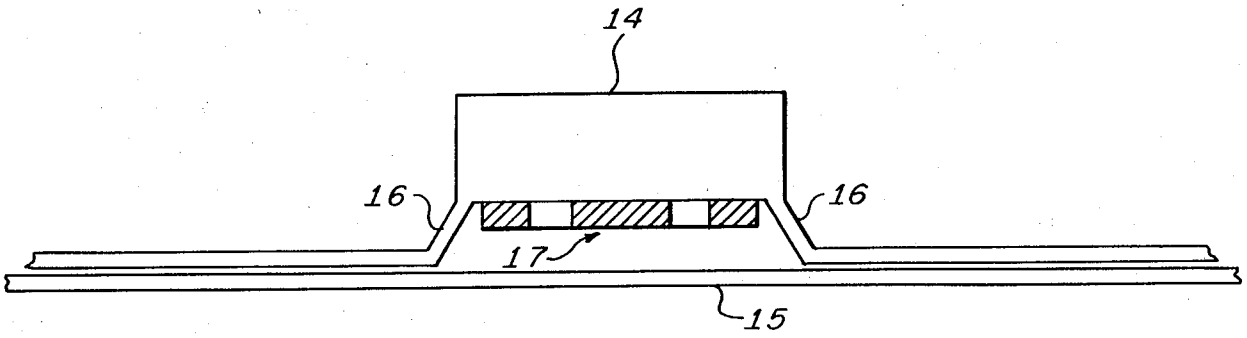
FIGS. 3A and 3B illustrate a switch employing the principles of the invention.
Figure 3B:
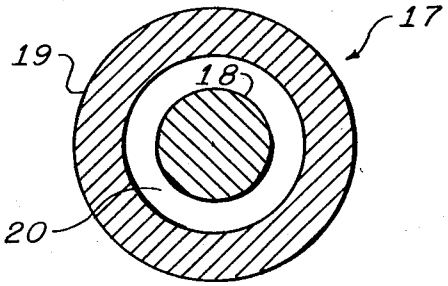

FIGS. 3A and 3B include a cross-sectional view of a keypad switch and a plan view of a shorting puck for a switch constructed in accordance with the principles of the invention to perform the functions indicated in FIG. 1 of the dual multipole switch.

The switch of the present invention resembles the prior art switch previously described in that it includes a rubber key member 14 supported over a printed circuit card 15 by an elastic membrane 16. However, the switch of the invention differs from that of the prior art in the layouts of the shorting puck 17 and the associated exposed trace array on the printed circuit card.

The composite puck of the present invention consists of three elements: an inner conductive rubber element or puck 18, a concentric outer conductive rubber element or puck 19, and an intermediate non-conductive insulating ring 20.

Figure 4:
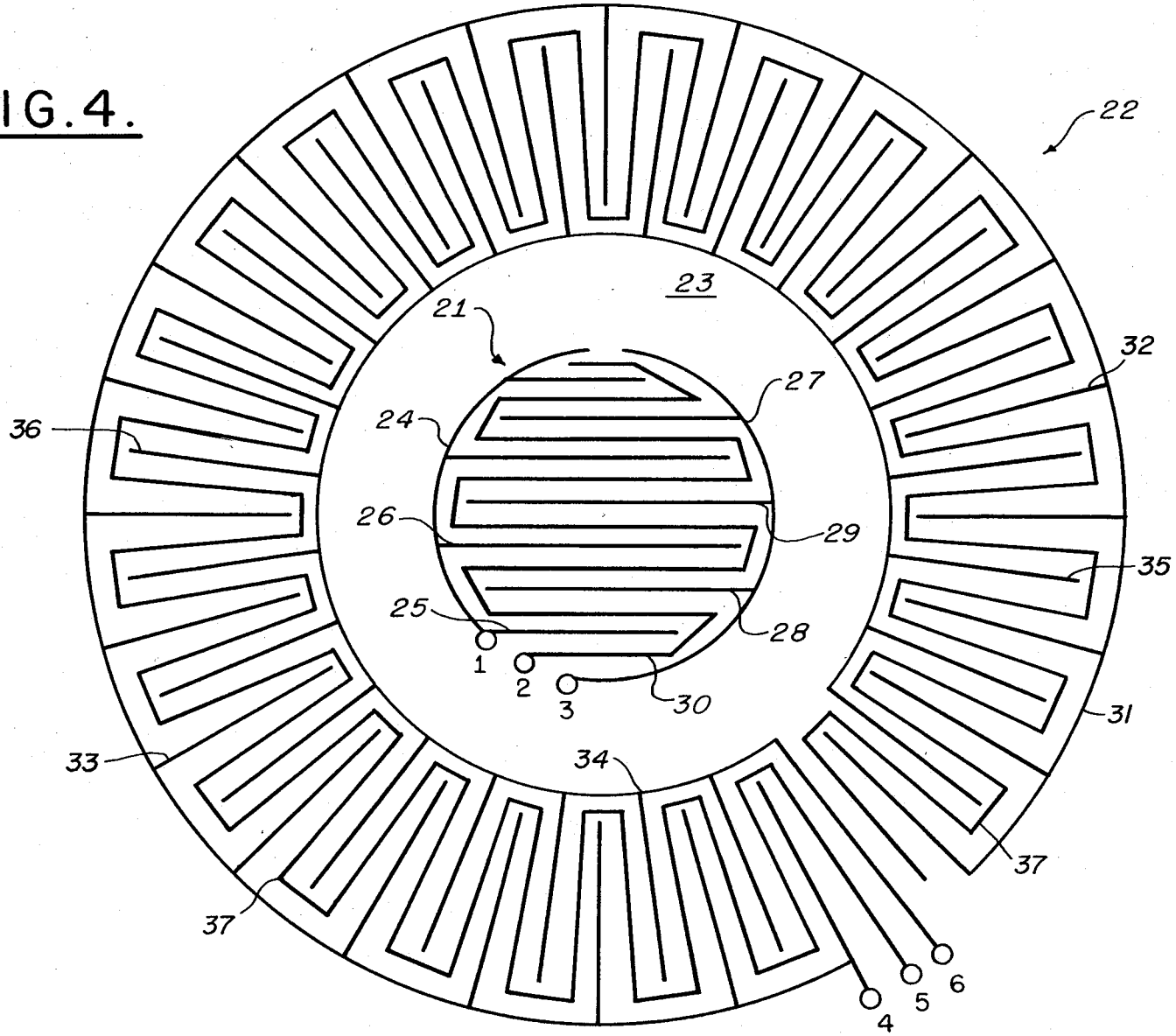
FIG. 4 illustrates an exposed trace array useful in practicing the invention.

The exposed traces on the printed circuit card are depicted in FIG. 4 in enlarged form for each of understanding.

As shown in FIG. 4, the total artwork comprising the exposed traces consists of a circular inner array 21, and an outer concentric array 22 separated from the inner array by a concentric non-conductive space 23 devoid of exposed traces. It will be understood that the dimensions of the inner and outer arrays as well as the non-conductive space 23 are selected to mate with the corresponding areas on the shorting puck.

Although the exact format of the artwork is largely a matter of choice in design, in general it is desirable to use as many exposed traces as possible without violating the width and spacing requirements. In the design illustrated in FIG. 4, terminal 1 of the inner array is connected to an arcuate exposed trace 24 interconnecting a series of parallel, spaced, exposed trace "fingers" such as fingers 25 and 26. Similarly, terminal 3 is connected to an arcuate exposed trace 27 interconnecting a second set of parallel exposed trace fingers such as fingers 28 and 29 interposed between the fingers of the first set. Terminal 2 is connected to a single exposed trace which follows a zigzag path between the fingers of the first and second sets. As illustrated in FIG. 4, terminal 4 of the outer array 22 is connected to an outer arcuate exposed trace 31 interconnecting a first set of radial exposed trace fingers, such as fingers 32 and 33. Similarly, terminal 6 is connected in an inner arcuate exposure trace 34 interconnecting a second set of radial exposed trace fingers, such FIGS. 35 and 36. Terminal 6 is connected to a continuous exposed trace 37 which follows a zig-zag path between the first and second sets of radial fingers.

It is apparent from FIGS. 3A, 3B, and 4 that suppression of the rubber key member 14 creates a short circuit between elements of the inner array 21, thereby connecting terminals 1, 2, and 3, and simultaneously creates a short circuit between the elements of the outer array 22, thereby connecting the terminals 4, 5, and 6.

The exposed traces may be formed from any of a number of materials known to those skilled in the art. Gold plated copper, silver plated copper or conductive carbon paste are likely materials, for example. Selection ordinarily will depend upon the particular application.

Because of the circular configuration of the shorting pucks and the arrays 21 and 22, the shape of the key 14 can be circular or square, rather than an elongated rectangle as in the prior art. Thus, the chance of collapsing only one end of the key is significantly reduced. However, even if one side of the key is accidentally depressed such that only half of the puck makes contact with the printed circuit card, it is highly probable that both switches will be activated properly.

It should be emphasized that although only two sets of switches have been described in the foregoing material, more switching functions can be performed by increasing the number of concentric arrays in the printed circuit card and the number of concentric conductive rings in the composite shorting puck assembly.

While the invention has been described in its preferred embodiments, it is to be understand that the words which have been used are words of description rather than of limitation and that changes within the purview of the appended claims may be made without departure from the true scope and spirit of the invention in its broader aspects.

I claim:

1. In a keypad switch of the type including a key having shorting pucks on its underside and supported above exposed trace patterns on a printed circuit card by a flexible membrane whereby pressure on the key collapses the membrane and permits the shorting pucks to contact with the exposed trace patterns thereby closing the switch, the improvement wherein said shorting pucks include a central circuit puck electrically isolated from an annular puck thereabout, said annular puck being co-planar and concentric with said circular puck, and wherein said exposed trace patterns are formed in a circular region and an annular region co-planar and concentric with said circular region, exposed trace patterns in said circular region being electrically isolated from trace patterns in said annular region, said circular region and said annular region being correspondingly aligned with said circular puck and said annular puck.

2. The switch of claim 1 wherein said exposed trace patterns include a plurality of electrically isolated exposed trace elements each having a switch terminal.

3. The switch of claim 2 wherein said exposed trace pattern in said circular region includes two trace elements formed along a circumferential border of said circular region, said two exposed trace elements each including a plurality of exposed trace fingers being further arranged so that said exposed trace fingers coupled to one of said two exposed trace elements are interposed between said exposed trace fingers coupled to the other of said two exposed trace elements, a third exposed trace element comprising electrically connected segments interposed between said exposed trace fingers of said two exposed trace elements and extending continuously in said circular region in a zigzag fashion.

4. The switch of claim 3 wherein said exposed trace fingers of said two exposed trace elements and said segments of said third exposed trace element are arranged to be a parallel relationship.

5. The switch of claim 2 wherein said plurality of exposed trace elements of said annular region includes a first trace element formed along an inner circumferential border of said annular region, a second exposed trace element formed along an outer circumferential border of said annular region, and a third exposed trace element extending in a continuous, undulating manner in said annular region between said first and second trace elements, said first and second trace elements further including exposed trace fingers alternately positioned in an interleaved manner in said annular region and said third trace element having electrically connected segments interposed between said exposed trace fingers of said first and second trace elements.

6. The switch of claim 5 wherein said exposed trace fingers of said first and second exposed trace elements and said segments of said third exposed trace element extend along radials of said annular region.

* * * * *